United States Patent [19]

Beigay

[11] 4,302,658

[45] Nov. 24, 1981

[54] WELDING SILICON STEEL

[75] Inventor: Jack M. Beigay, Freeport, Pa.

[73] Assignee: Allegheny Ludlum Steel Corporation, Pittsburgh, Pa.

[21] Appl. No.: 191,972

[22] Filed: Sep. 29, 1980

Related U.S. Application Data

[63] Continuation-in-part of Ser. No. 71,519, Aug. 31, 1979, abandoned, which is a continuation of Ser. No. 886,303, Mar. 31, 1978, abandoned.

[51] Int. Cl.[3] ..... B23K 9/23; H01F 1/04

[52] U.S. Cl. ..... 219/137 R; 228/231; 148/112; 148/127

[58] Field of Search ..... 219/137 R; 148/110, 148/112, 127; 228/231, 212

[56] References Cited

U.S. PATENT DOCUMENTS

| | | | |
|---|---|---|---|
| 2,162,229 | 6/1939 | Remington | 48/127 X |
| 3,384,732 | 5/1968 | Decker . | |
| 3,400,239 | 9/1968 | Fahrenbach . | |
| 4,120,440 | 10/1978 | Kirkwood et al. | 228/231 |
| 4,129,244 | 12/1978 | Morris | 228/212 X |
| 4,244,757 | 1/1981 | Malagari, Jr. et al. | 148/112 X |

FOREIGN PATENT DOCUMENTS

| | | | |
|---|---|---|---|
| 982916 | 2/1976 | Canada | 228/231 |
| 478592 | 4/1979 | Spain . | |

OTHER PUBLICATIONS

American Welding Society, *Welding Handbook*, Sixth Edition, 1968; Section 1 pp. 5.24–5.25, Section 2 p. 27.3, Section 5 p. 85.60.

Cary, Howard B.; *Modern Welding Technology*; Prentice-Hall, Inc.; N.J.; 1979; pp. 264–268 and pp. 637–641.

*Primary Examiner*—Gene Z. Rubinson
*Assistant Examiner*—Keith E. George
*Attorney, Agent, or Firm*—Vincent G. Gioia; William J. O'Rourke, Jr.

[57] ABSTRACT

A process for improving the mechanical properties of welded silicon steel. The weld heat affected area of welded silicon steel is heat treated while retaining the welded lengths within a clamping fixture so as to restrain movement thereof from the initiation of welding through the completion of the heat treatment.

1 Claim, No Drawings

WELDING SILICON STEEL

SUMMARY OF THE INVENTION

The present invention is a continuation-in-part of Application Ser. No. 071,519 filed Aug. 31, 1979, now abandoned concurrently with the filing of this application, which in turn is a continuation of Ser. No. 886,303 filed Mar. 31, 1978, now abandoned.

The present invention relates to a process for improving the mechanical properties of welded silicon steel, and in particular, boron-bearing silicon steel.

As the heat developed during the welding of boron-bearing silicon steels often embrittles the steel in the weld heat affected area, a means for improving the mechanical properties of the metal in the weld heat affected area had to be developed. Post weld heat treatments were tried, but resulted in heat warpage and weld cracking.

Through the present invention there is provided a process for improving the mechanical properties of the metal in the weld heat affected area. The weld heat affected area is heat treated with the lengths of welded steel clamped so as to restrain movement thereof. By so clamping the welded lengths, the present invention provides a means of improving mechanical properties without the heat warpage and weld cracking characteristic of previous attempts at post welding heat treatments.

It is accordingly an object of the present invention to provide a process for improving the mechanical properties of welded silicon steel.

In accordance with the present invention, two lengths of silicon steel are welded, and heat treated in the weld heat affected area. The heat treating is carried out with the lengths retained within the same clamping fixture that was used for welding so as to restrain movement thereof from the initiation of welding through the completion of the heat treatment. By heat treating the metal with the lengths still clamped, the present invention provides a means of improving mechanical properties in the weld heat affected area without heat warpage and heat cracking.

In the present invention, the lengths remain clamped for heat treatment in the same fixture that is used to hold the lengths during welding.

The type of welding is generally electric arc welding. Typical forms of electric arc welding are gas tungsten arc welding, gas metal arc welding and submerged arc welding. The non-consumable electrode used in gas tungsten arc welding could be passed over the weld as a source of heat. An arc would be struck between said electrode and the welded lengths of steel. Alternatively, a torch such as oxygen-acetylene torch could be used. Heat treating is performed at a temperature below that at which additional grain growth develops in the heat affected zone of the weld. Specific temperature cannot be set forth as they are dependent upon the chemistry of the steel as well as time at temperature. As it is surmised that embrittling phases form during welding, it is further surmised that time and temperature should be such as to allow the embrittling phases to redissolve. Practically speaking, temperatures should be in excess of 1500° F., and below the critical temperature which promotes grain growth.

The following examples are illustrative of several aspects of the invention. Although the examples are directed to boron-bearing silicon steels having up to 0.06% carbon, 0.015 to 0.15% manganese, 0.01 to 0.05% of material from the group consisting of sulfur and selenium, 0.0006 to 0.0080% boron, up to 0.0100% nitrogen, up to 1.0% copper, 2.5 to 4.0% silicon, balance iron; there is reason to believe that the invention would pertain to other silicon steels which form embrittling phases during welding.

EXAMPLE I

Two lengths of steel were gas tungsten arc welded. The electrode traveled at a speed of 38.5 inches per minute. A current of 200 amps was passed. The steel had a nominal thickness of 0.080 inch. Other welding parameters were as follows:

Shielding Gas: Helium at 25 cfh top only
Copper Chill Bar: ⅛" wide×0.010" deep groove
Cooper Hold-downs: ¼" spacing
Electrode: 2% Thoriated Tungsten 3/32" dia.

After welding, the welded lengths broke with only slight bending.

Two other lengths of welded steel were heat treated with the lengths retained in the same clamping fixture used for welding so as to restrain movement thereof throughout the welding and heat treating steps. The welded lengths were retained clamped in the fixture which was used to weld them. Welding was the same as that described in the preceding paragraph. Heat treating was accomplished, without removing the clamped fixture, by passing the welding electrode over the weld at a reduced current of 60 amps. The welding electrode passed over the weld four times at a speed of 32.5 inches per minute. After heat treating, the welded lengths were bent over a three inch diameter bar. The weld did not crack during bending. By heat treating the welded lengths in accordance with the present invention, a notable improvement was detectable. Heat warpage and weld cracking were not a problem.

The welded and heat treated lengths were subsequently cold rolled to a nominal thickness of 0.010 inch. No edge cracking was observed. Therefore, this process is considered to be a significant contribution to the state of the art.

EXAMPLE II

Two lengths of steel were gas tungsten arc welded. The electrode traveled at a speed of 25 inches per minute. A current of 21 amps was passed. The steel had a nominal thickness of 0.024 inch. Other welding parameters were as follows:

Shielding Gas: Helium at 25 cfh top only
Copper Chill Bar: 3/32" wide×0.005" deep groove
Copper Hold-downs: ¼" spacing
Electrode: 2% Thoriated Tungsten 1/16" dia.

After welding, the welded lengths broke with only moderate bending.

Two other lengths of welded steel were heat treated with the lengths retained in the same clamping fixture used for welding so as to restrain movement thereof throughout the welding and heat treating steps. The welded lengths were retained clamped in the fixture which was used to weld them. Welding was the same as that described in the preceding paragraph. Heat treating was accomplished, without removing the clamped fixture, by passing the welding electrode over the weld at a reduced current of 10 amps. The welding electrode passed over the weld two times at a speed of 32.5 inches per minute. After heat treating, the welded lengths were bent at a 90° angle. The weld did not crack during bending. By heat treating the welded lengths in accordance with the present invention, a notable improvement was detectable. Heat warpage and weld cracking were not a problem.

The welded and heat treated lengths were subsequently cold rolled to a nominal thickness of 0.010 inch. No edge cracking was observed. Therefore, this process is considered to be a significant contribution to the state of the art.

EXAMPLE III

Two lengths of steel were submerged arc welded. The steel had a nominal thickness of 0.082 inch. Welding was accomplished with a copper coated, high manganese carbon steel electrode. The electrode traveled at a rate of from 50 to 60 inches per minute. A current of from 350 to 400 amps was passed. After welding, the steel was heat treated with its lengths retained clamped so as to continue to restrain movement thereof. The welded lengths were retained clamped in the fixture which was used to weld them throughout the welding and heat treating steps. Heat treating was accomplished by passing an oxygen-acetylene torch over the weld at a speed of 10 inches per minute. The torch was 1 inch above the weld heat affected area.

The welded and heat treated lengths were successfully cold rolled to a nominal thickness of 0.010. No edge cracking was observed. The heat treatment significantly improved the properties of the processed steel.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for welding two lengths of steel having from 2.5 to 4.0% silicon and less than 0.008% boron, comprising the steps of:

clamping said lengths in a fixture to restrain movement thereof, welding said clamped lengths, and heat treating the weld heat affected area of said lengths at a temperature in excess of 1500° F., wherein the improvement comprises:

retaining said clamped lengths within the fixture from the initiation of the welding step through the completion of the heat treating step, and after heat treating, cold rolling the welded length.

* * * * *